US005158580A

United States Patent [19]

Chang

[11] Patent Number: 5,158,580

[45] Date of Patent: * Oct. 27, 1992

[54] COMPACT HYBRID PARTICULATE COLLECTOR (COHPAC)

[75] Inventor: Ramsay Chang, Los Altos, Calif.

[73] Assignee: Electric Power Research Institute, Palo Alto, Calif.

[ * ] Notice: The portion of the term of this patent subsequent to Jun. 8, 2008 has been disclaimed.

[21] Appl. No.: 651,949

[22] Filed: Feb. 7, 1991

Related U.S. Application Data

[63] Continuation-in-part of Ser. No. 451,517, Dec. 15, 1989, Pat. No. 5,024,681.

[51] Int. Cl.[5] ..... B03C 1/00

[52] U.S. Cl. ..... 55/6; 55/124; 55/131; 55/341.1

[58] Field of Search ..... 55/124, 6, 131, 341.1

[56] References Cited

U.S. PATENT DOCUMENTS 1,853,393 4/1932 Anderson ..... 55/6
3,966,435 6/1976 Penney ..... 55/131
4,357,151 11/1982 Helfritch et al. ..... 55/6
5,024,681 6/1991 Chang ..... 55/6

FOREIGN PATENT DOCUMENTS 52-65000 5/1979 Japan ..... 55/131
176909 7/1988 Japan ..... 55/124

*Primary Examiner*—Bernard Nozick
*Attorney, Agent, or Firm*—Leonard Bloom

[57] ABSTRACT

A method and apparatus for efficient removal of particulates from a gas is described which incorporates a barrier filter (e.g. baghouse) internally of an electrostatic precipitator. An alternative embodiment is disclosed which incorporates an electrostatic precipitator and a barrier filter (i.e. baghouse) in series, with a precharger interposed therebetween. The series arrangement enables the barrier filter to operate at significantly higher filtration velocities than normal 4.06–20.32 cm/s (8–40 ft/min) versus 0.76–2.54 cm/s (1.5–5 ft/min) and reduces the size of the barrier filter significantly. The precharger adds an additional electrostatic charge to particulates exhausted from the electrostatic precipitator and replaces charge lost in lengthy and poorly insulated conduits.

4 Claims, 5 Drawing Sheets

COMPACT HYBRID PARTICULATE COLLECTOR (COHPAC)

CROSS-REFERENCE TO RELATED APPLICATIONS

This application is a continuation-in-part of application Ser. No. 451,517, filed Dec. 15, 1989 now U.S. Pat. No. 5,024,681.

BACKGROUND OF THE INVENTION

1. Field of the Invention

This invention relates to pollution control, namely filtering of particulate matter, and more specifically, to filtering of flyash and other particulates from flue gas.

2. Description of the Prior Art

Currently, there are approximately 1200 coal-fired utility power plants representing 330,000 MWe of generating capacity that are equipped with electrostatic precipitators. Present precipitators typically remove 90–99.9% of the flyash in the flue gas. However, existing and pending regulations to control sulfur dioxide emissions from the flue gas require utilities to switch fuel types (such as from high to low sulfur coal), or add sulfur dioxide control upstream of the precipitators. Fuel switching and sulfur control upstream of the precipitators generally modify flyash properties, reduce precipitator collection efficiency, and increase stack particulate emissions. In addition, particulate emissions standards are getting increasingly stringent. Faced with these increasingly strict environmental requirements, utilities are looking for low cost retrofits to upgrade the performance of their precipitators.

It is well known in the art how to build and use electrostatic precipitators. It is also known in the art how to build and use a barrier filter such as a baghouse. Further, it is known in the art how to charge particles and that charged particles may be collected in a barrier filter with lower pressure drop and emissions than uncharged particles collected for the same filtration velocity.

Electric power utility companies are looking for ways to upgrade their precipitators. One approach would be to replace the existing under-performing precipitator with a baghouse or barrier filter or conventional design which are generally accepted as an alternative to precipitators for collecting flyash from flue gas. Conventional designs can be categorized as low-ratio baghouses (reverse-gas, sonic-assisted reverse-gas, and shake-deflate) which generally operate at filtration velocities of 0.76 to 1.27 centimeters per second (1.5 to 2.5 ft/min), also defined as air-to-cloth ratio, volumetric flow rate of flue gas per unit of effective filter area, or (cubic feet of flue gas flow/min/square foot of filtering area), and high-ratio pulse-jet baghouses which generally operate at 1.52 to 2.54 centimeters per second (3 to 5 ft/min). Baghouses generally have very high collection efficiencies (greater than 99.9%) independent of flyash properties. However, because of their low filtration velocities, they are large, require significant space, are costly to build, and are unattractive as replacements for existing precipitators. Reducing their size by increasing the filtration velocity across the filter bags will result in unacceptably high pressure drops and outlet particulate emissions. There is also potential for "blinding" the filter bags—a condition where particles are embedded deep within the filter and reduce flow drastically.

In U.S. Pat. No. 3,915,676 which issued on Oct. 28, 1975 to Reed et al., an electrostatic dust collector is disclosed where the dirty gas is moved through an electrostatic precipitator to remove most of the particulate matter. The gas stream then passes through a filter having a metal screen and dielectric material wherein an electric field is applied to the filter which permits a more porous material to be used in the filter. The filter is of formacious and dielectric material to collect the charged fine particles. The filter and precipitator are designed in a concentric tubular arrangement with the dirty gas passing from the center of the tubes outward.

In U.S. Pat. No. 4,147,522 which issued on Apr. 3, 1979 to Gonas et al., the dirty gas stream passes through a tubular precipitator and then directly into a filter tube in series with the precipitator tube. The particles are electrically charged and are deposited on the fabric filter which is of neutral potential with regard to the precipitator. The major portion of the particles are however deposited in the electrostatic precipitator. No electric field is applied to the fabric filter. Precipitator and filter tube are cleaned simultaneously by a short burst of air.

In U.S. Pat. No. 4,354,858 which issued on Oct. 19, 1982 to Kumar et al., electrically charged particles in a gas stream are filtered from the stream by a filter medium which includes a porous cake composed of electrically charged particulates previously drawn from the gas stream and collected on a foraminous support structure.

In U.S. Pat. No. 4,357,151 which issued on Nov. 2, 1982 to Helfritch et al., an apparatus is disclosed which first moves dirty gas through a corona discharge electrodes located in the spaced between mechanical filters of the cartridge type having a filter medium of foraminous dielectric material such as pleated paper. The zone of corona discharge in the dirty gas upstream of the filter results in greater particle collection efficiency and lower pressure drop in the mechanical filters.

In U.S. Pat. No. 4,411,674 which issued on Oct. 25, 1983 to Forgac, a cyclone separator is disclosed wherein a majority of the dust is removed from dirty air in a conventional fashion followed by a bag filter. The bottoms of the filter bags have open outlets for delivering dust into a bottom chamber. The particulates are continuously conducted out of the bag filter apparatus for recirculation back to the cyclone separator.

In all the above patents, the inventors are looking for ways to reduce pressure drop and emissions across a barrier filter by precharging or mechanical precollection of the particles in the gas stream.

SUMMARY OF THE INVENTION

In accordance with the present invention, a method for removing particulates from a flue gas is described comprising the steps of flowing the flue gas through an electrostatic precipitator which imparts a residual electrostatic charge on remaining particulates exhausted therefrom, flowing the flue gas exhausted from the electrostatic precipitator through a precharger downstream of said electrostatic precipitator for imparting an additional electrostatic charge, and flowing the flue gas through a barrier filter downstream of the pre-charger at a high filtration velocity in the range of from 4.06–20.32 centimeters per second (8–40 feet per minute), the barrier filter collecting the remaining particulates before the electrostatic charge imparted by said electrostatic precipitator and said precharger substantially dissipates.

Further, an apparatus is disclosed for implementing the above-described method, the apparatus comprising an electrostatic precipitator for removing 90–99% of particulates in said flue gas, and for imparting a residual electrostatic charge on remaining particulates exhausted therefrom in said flue gas, a pre-charger placed downstream of the electrostatic precipitator and in fluid communication therewith, the pre-charger imparting an additional electrostatic charge on remaining particulates, and a barrier filter placed downstream of said pre-charger and in fluid communication therewith, the barrier filter filtering said flue gas at a high filtration velocity in the range of from 4.06–20.32 centimeters per second (8–40 feet per minute), whereby the barrier filter collects the remaining particulates exhausted in the flue gas before the electrostatic charge imparted by said electrostatic precipitator and said pre-charger substantially dissipates.

The invention further provides retrofit filtering of flue gas from a combustion system in accordance with the above-described method and apparatus, and in accordance with a second embodiment of the present invention in which the last field of a multi-field precipitator is replaced by a conventional baghouse.

BRIEF DESCRIPTION OF THE DRAWINGS

Other objects, features and advantages of the present invention will become more apparent from the following detailed description of preferred embodiments and certain modifications thereof when taken together with the accompanying drawings, in which.

DESCRIPTION OF THE PREFERRED EMBODIMENTS

Figure 1:
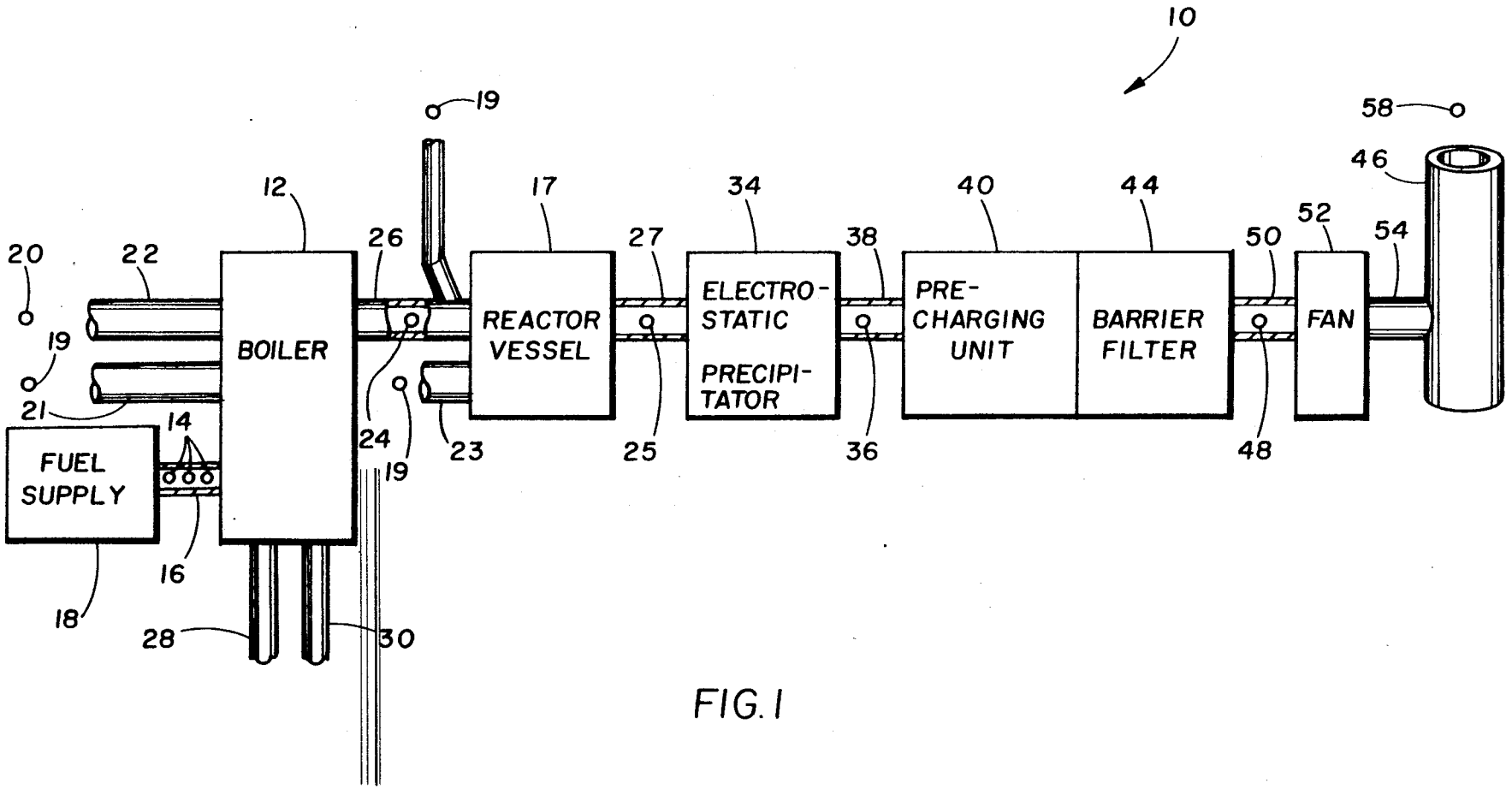
FIG. 1 is a block diagram of a flue gas treatment system according to one embodiment of the present invention.

Referring now to the drawings, FIG. 1 shows a block diagram of a first embodiment of the invention comprising a flue gas treatment system 10 for the treatment of flue gas exiting a boiler 12 of the type used in a utility fossil-fuel-fired power plant. It should be recognized that the invention applies equally well to any process that requires gas stream particulate control. Fuel supply 18 may be, for example, coal, oil, refuse derived fuel (RDF) or municipal solid waste (MSW). Boiler 12 also receives air 20 over inlet duct 22. Boiler 12 functions to combust the fuel 14 with air 20 to form flue gas 24 which exits boiler 12 by means of outlet duct 26. Boiler 12 also has a water inlet pipe 28 and a steam outlet pipe 30 for removing heat in the form of steam from boiler 12 generated by the combustion of fuel 14 with air 20.

Flue gas 24 is comprised of components of air and the products of combustion in gaseous form which include: water vapor, carbon dioxide, halides, volatile organic compounds, trace metal vapors, and sulfur and nitrogen oxides and the components of air such as oxygen and nitrogen. Flue gas 24 also contains particulates comprising unburned and partially combusted fuel which includes inorganic oxides of the fuel (known as flyash), carbon particles, trace metals, and agglomerates. Flue gas 24 may also contain particulates generated by the addition of removal agents 19 for sulfur oxide and other gas phase contaminates such as halides and trace metal vapors which are added into boiler 12 by way of duct 21, into duct 26, or into reactor vessel 17 by way of duct 23 upstream of the precipitator 34. Ducts 21, 26 and 23 may also convey solid materials if required for the selected removal agents 19 for the respective duct. Examples of sulfur oxide and other gas phase contaminate removal agents 19 include calcium carbonates, oxides and hydroxides, and sodium carbonates and bicarbonates. The particles or particulates in flue gas 24 can vary considerably in size, shape, concentration and chemical composition.

Flue gas 24 passes through duct 26 through reactor vessel 17 and through duct 27 as flue gas 25 to an inlet of electrostatic precipitator 34 which functions to charge and collect particles on electrodes within the electrostatic precipitator 34. Reactor vessel 17 may facilitate the chemical reaction of removal agents 19 with flue gas 24 to provided treated flue gas 25. Electrostatic precipitator 34 may remove, for example, from 90–99.9% of the particles and/or particulates. Therefore, flue gas 24 exits electrostatic precipitator 34 as treated flue gas 36 entering outlet duct 38. Treated flue gas 36 has roughly from 0.1–10% of the particulates or particles contained in the original flue gas 24 and also contains a certain amount of electrostatic charge which was transferred to it from the electrostatic precipitator 34. These particles were not collected within the electrostatic precipitator but exited at outlet duct 38.

The particle concentration in the flue gas 36 exiting the electrostatic precipitator 34 is reduced significantly by the precipitator and contains a residual charge imparted by the precipitator. These characteristics permit highly efficient filtering.

Figure 2:
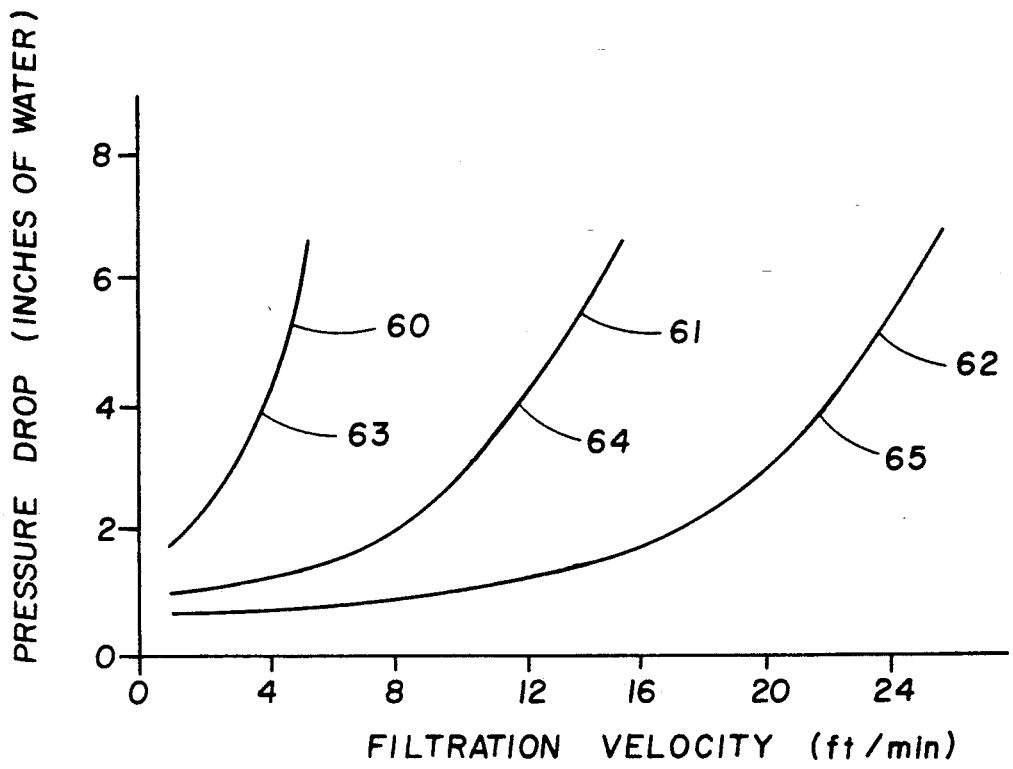
FIG. 2 is a graphical description of the effect of low particle concentrations and the charging of particles on barrier filter pressure drop.

For instance, a hypothetical situation which describes the effect of low particle concentrations and the charging of particles on barrier filter pressure drop is shown in FIG. 2. Curve 60 in FIG. 2 shows the pressure drop across a barrier filter filtering particles from flue gas directly from boiler 12 in FIG. 1 without prefiltering by an electrostatic precipitator 34. Curve 61 shows what would happen when a significant portion of the particles in the flue gas is removed by an electrostatic precipitator 34 before entering the barrier filter 44, and assuming that the particles entering the barrier filter 44 have no electrical charge. Curve 62 shows what would happen to the pressure drop depicted by curve 61 if a residual electrical charge is carried by the particles exiting the electrostatic precipitator 34 and entering the barrier filter 44. It can be seen that for the same pressure drop across the barrier filter, indicated by points 63, 64 and 65 on curves 60–62 respectively, in FIG. 2, the condition represented by curve 62 allows significantly higher filtration velocity (also defined as air-to-cloth ratio or volumetric flow rate of flue gas per unit of effective filter area) than the other conditions represented by curves 60 and 61. A barrier filter downstream of an electrostatic precipitator and collecting particles having a residual electrical charge is capable of operation at a filtration velocity of 11.18 centimeters per second (22 ft/min) versus 2.03 centimeters per second (4 ft/min) for a barrier filter filtering flue gas without precleaning and charging by an electrostatic precipitator.

Figure 3:
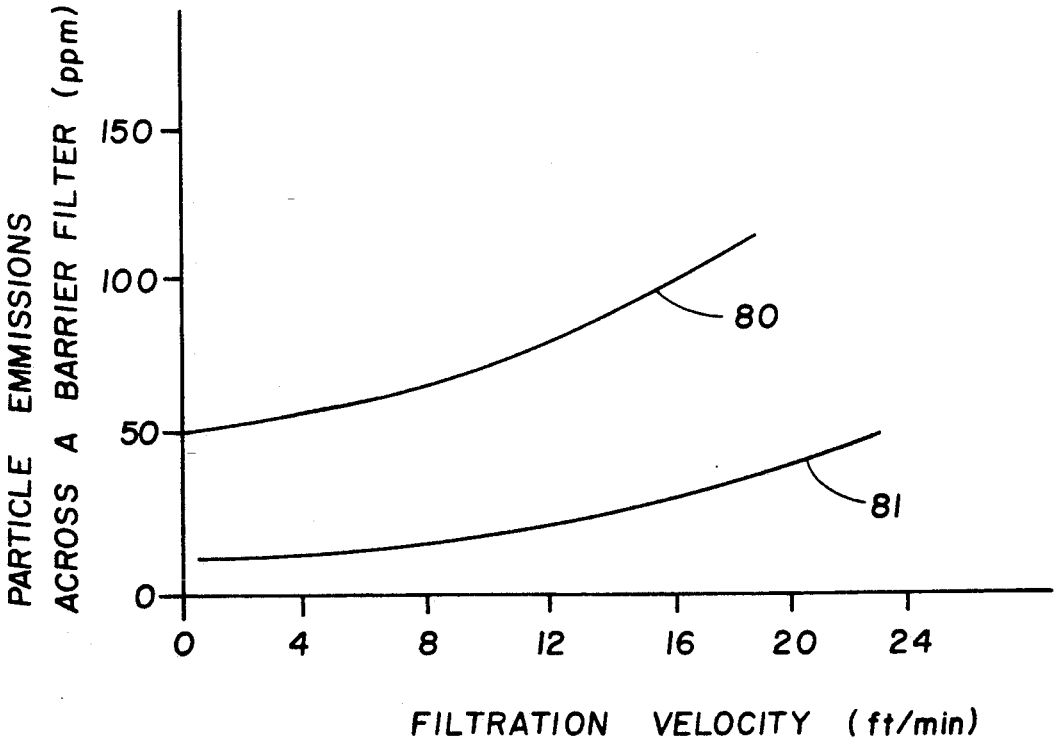
FIG. 3 is a graphical description of the effect of particle charging and filtration velocity on the particle penetration across a barrier filter.

FIG. 3 is a hypothetical situation showing the effect of particle charging and filtration velocity on the particle penetration across a barrier filter. The particle penetration across a barrier filter increases as the filtration velocity increases as shown by curve 80 but is enhanced significantly by charging the particles as shown by curve 81. Thus, the charged particles exiting the electrostatic precipitator could be filtered at high filtration velocities without increasing emissions across the barrier filter. Because of the low particle loading and the electrical charge on the particles, a downstream barrier filter 44 can be adjusted in size to filter flue gas 36 at filtration velocities (also called air-to-cloth ratio) in the range from 4.06–20.32 centimeters per second (8–40 feet per minute).

The above-described advantages depend on the proximity of the barrier filter 44 to electrostatic precipitator 34. Therefore, barrier filter 44 is preferably very close to electrostatic precipitator 34 so as to receive particulates retaining the maximum residual charge imparted by electrostatic precipitator 34. Unfortunately, in many instances it is not structurally feasible to place electrostatic precipitator 34 in proximity to barrier filter 44. In such cases the duct(s) connecting electrostatic precipitator 34 with barrier filter 44 may be prolonged and insufficiently insulated. Consequently, the particles or particulates previously charged in electrostatic precipitator 34 will lose their electrostatic charge prior to collection by barrier filter 44

The embodiment shown in FIG. 1 compensates for the above-described loss of charge. In FIG. 1, a pre-charging unit 40 is constructed integrally with barrier filter 44.

Figure 4:
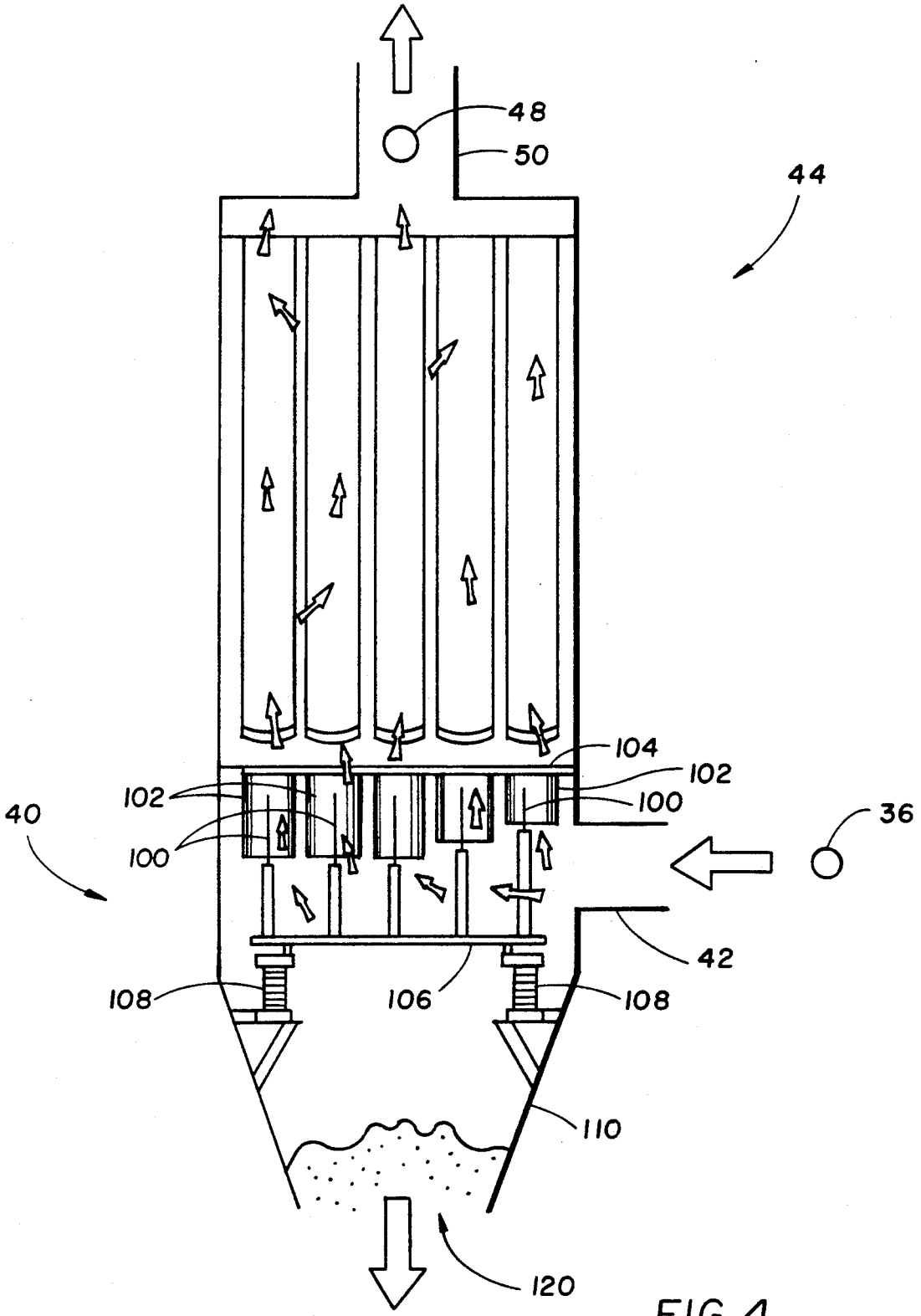
FIG. 4 illustrates one example of pre-charging unit 40 of FIG. 1.

FIG. 4 illustrates one example of the pre-charging unit 40 of FIG. 1. Pre-charging unit 44 comprises a plurality of elongate discharge electrodes 100 protruding into a corresponding plurality of discharge conduits 102, the discharge conduits 102 being in fluid communication with barrier filter 44. The discharge electrodes 100 are mounted on a conductive plate 106, which is in turn held by insulated supports 108 positioned at the edges of plate 106. The discharge conduits are also mounted on a conductive plate 104. All of the above-described components are contained in pre-charging unit housing 110, which extends downwardly to a dust discharge vent 120. A voltage potential is applied between plates 104 and 106.

In operation, flue gas 36 enters pre-charging unit 40 through inlet duct 42. The flue gas 36 cycles upward through conduits 102 toward barrier filter 44. While the flue gas 36 is inside conduits 102, an electrostatic charge is imposed by oppositely charged discharge electrodes 100 and discharge conduits 102. Particles which agglomerate as a result of the charge may settle out of pre-charging unit 40 via dust discharge vent 120. The remaining charged particles in flue gas 36 continue to move upward into barrier filter 44.

Referring back to FIG. 1, flue gas 48 exiting barrier filter 44 passes over outlet duct 50 through fan 52 and duct 54 to the inlet of smoke stack 46. Flue gas 48 exits smoke stack 46 as gas 58, which in turn mixes with the ambient air or atmosphere.

Fan 52 functions to overcome the additional pressure drop required to draw flue gas 48 across the barrier filter 44 to maintain a face velocity in the range from 4.06–20.32 centimeters per second (8–40 feet per minute) across barrier filter 44. Fan 52 also functions to draw flue gases 36 and 24 from electrostatic precipitator 34 and boiler 12 respectively. Fan 52 also functions to move flue gas 48 through duct 54 and out of smoke stack 46 as flue gas 58.

As a result of the above-described device the efficiency of the barrier filter 44 is maximized because the residual charge imparted by electrostatic precipitator 34 (and lost to conduit 38) is replenished by pre-charging unit 40.

Figure 5:
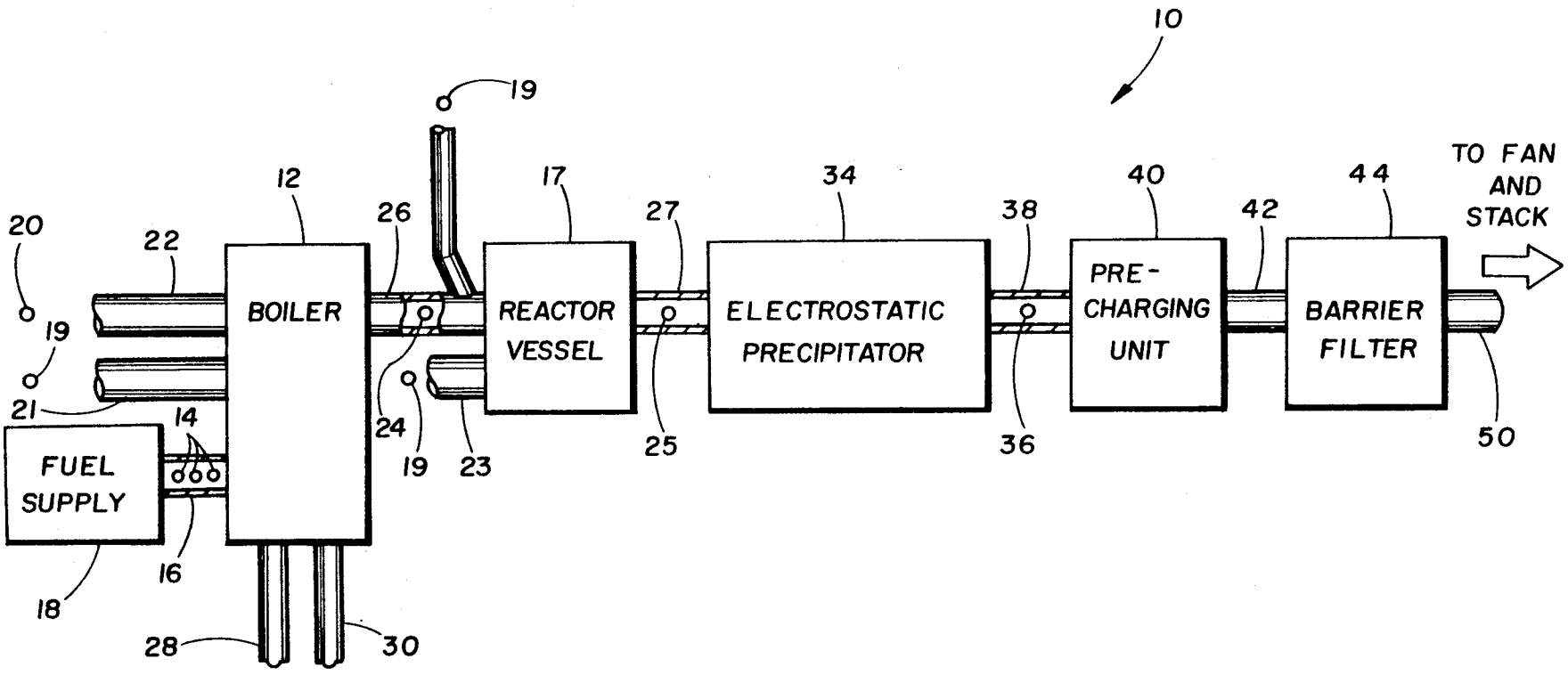
FIG. 5 illustrates a second embodiment of the invention having a pre-charging unit 40 interposed between the electrostatic precipitator 34 and barrier filter 44.

In alternative embodiments pre-charging unit 40 may be placed at other positions along the duct work. For example, FIG. 5 shows a second embodiment of the invention having a precharging unit 40 interposed between the electro-static precipitator 34 and barrier filter 44. The input of pre-charging unit 40 is connected to the electrostatic precipitator via duct 38, and the output of pre-charging unit 40 is connected to barrier filter 44 via duct 42. The operation of pre-charging unit 40 is the same as described above.

Examples of acceptable barrier filters 44 include baghouses of the pulse-jet type, reverse flow, or shake-deflate type for periodically removing the dust cake accumulated on the surface of the bag filter. Since the electrostatic precipitator 34 and the barrier filter 44 are separate devices, each can be cleaned independently of the other. By operating the barrier filter 44 with a higher face velocities of 4.06–20.32 centimeters per second (8–40 feet per minute) the size of the barrier filter with respect to conventional barrier filter is greatly reduced, thereby allowing both the barrier filter 44 and pre-charging unit 40 to be retrofit into existing boiler systems between the electrostatic precipitator and smoke stack 46. This allows substantial capital and installation cost savings and requires very little real estate for installation.

Figure 6:
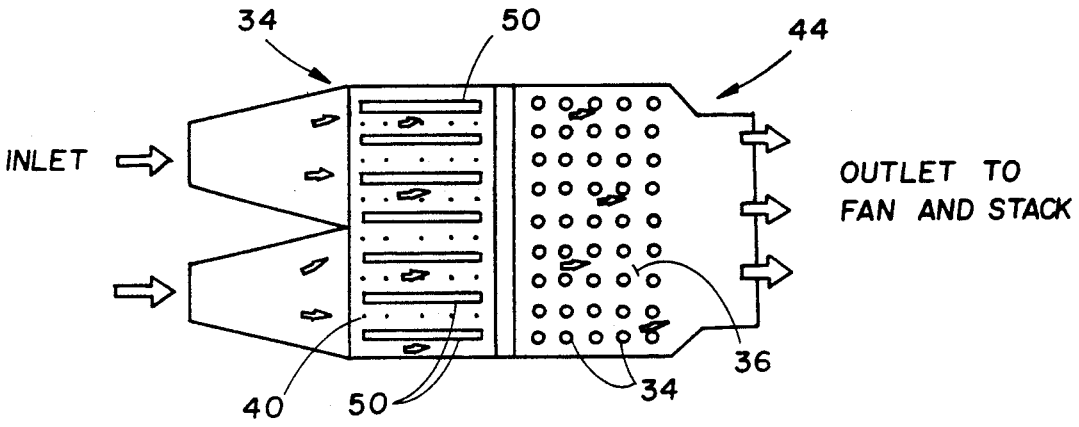
FIGS. 6 and 7 illustrate a plan view, and a side view, respectively, of a third embodiment of the present invention in which the last field of a multi-field precipitator is replaced by a conventional baghouse.
Figure 7:
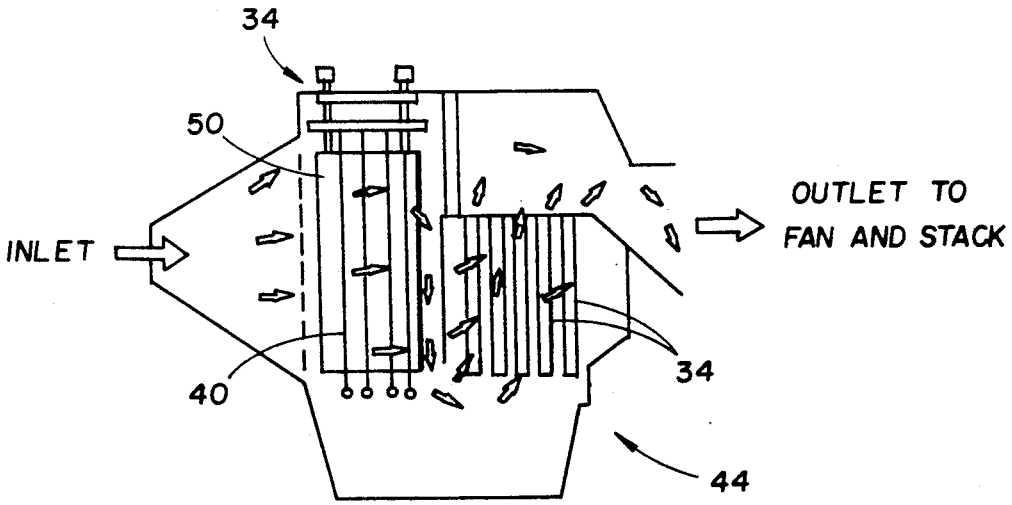

A third embodiment of the present invention for accomplishing the above-described and other objectives is shown in FIGS. 6 and 7. This embodiment is a simple retrofit for flue gas treatment systems having larger electrostatic precipitators (i.e. more than one electrostatic field). It has been found that the last field of the precipitator can be removed and replaced by a conventional baghouse. The reduced particle concentration in the flue gas exiting the remaining field(s) 50 of the electrostatic precipitator 34, coupled with the residual electrical charge imparted by the precipitator allows operation of the baghouse at very high filtration velocities. Hence, the baghouse can be made very compact. As shown in FIG. 6, a compact baghouse 44 can be retrofit into the space vacated by the eliminated field of precipitator 34, and no interconnecting ducts are necessary. As will be appreciated by those skilled in the art, "tubesheet" is a term of art designating a common support structure for baghouse filters. As shown in FIG. 6, a tubesheet 36 is used to suspend the filters of baghouse 44 within the space vacated by the eliminated field of precipitator 34. Tubesheet 36 is secured within the vacated space and subdivides the vacated space into a separate filter section (in which the filters of baghouse 44 are suspended) and an outlet section (which is typically connected to a downstream fan and stack. Pre-filtered flue gas exiting the remaining field(s) 50 of electrostatic precipitator 34 is further filtered by baghouse 44 in the separate filter section, and is then discharged through the tubesheet 36 and outlet section. FIG. 7 is a side-view of the retrofit device of FIG. 6.

Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A method for retrofit filtering of particulates in a flue gas from a combustion source having an existing conventional electrostatic precipitator connected thereto and a smoke stack connected to said precipitator, said electrostatic precipitator further comprising a plurality of electrostatic discharge electrodes and corresponding collecting electrodes enclosed within a housing, an inlet to said housing connected to said combustion source, and an outlet from said housing connected to said smokestack, the method comprising the steps of:

removing at least one discharge electrode and collecting electrode from within said housing of said electrostatic precipitator;

attaching a tubesheet within said housing to subdivide said space vacated by said removed electrodes into a separate filter section downstream of the remaining discharge and collecting electrodes, and an outlet section downstream of said separate filter section;

supporting a compact baghouse filter within said separate filter section by said tubesheet to filter particulates therein, said baghouse filter being proportioned to filter particulates at a high filtration velocity in the range of from 4.06–20.32 centimeters per second (8–40 feet per minute);

whereby said remaining discharge electrodes and corresponding collecting electrodes in said electrostatic precipitator serve to remove a majority of particulates from said flue gas and impart a residual charge on remaining particulates discharged to said separate filter section, and said remaining particulates are collected by said baghouse filter before said residual electric charge substantially dissipates.

2. The method of claim 1, wherein said combustion source is a fossil-fuel-fired boiler.

3. An apparatus for removing particulates from flue gas comprising:

an electrostatic precipitator having a housing enclosing separate particle removal sections, an inlet to said housing, and an outlet from said housing, said particle removal sections further comprising, an electrostatic removal section including a plurality of collecting electrodes and discharge electrodes enclosed within said housing for removing a substantial portion of particulates from said flue gas, and for imparting a residual electrostatic charge on remaining particulates in said flue gas, a separate filter section located downstream of said electrostatic removal section to filter said particulate before the residual charge imparted by said electrostatic removal section substantially dissipates, said separate filter section including a compact baghouse filter having a high filtration velocity in the range of from 4.06–20.32 centimeters per second (8–40 feet per minute), and an outlet section located downstream of said separate filter section and separated therefrom by a tubesheet installed within said housing to support said baghouse filter;

whereby a collection efficiency of said baghouse filter is enhanced by removing said substantial portion of particulates from said flue gas in said electrostatic removal section and imparting a residual charge on the remaining particulates discharged to said separate filter section, thereby allowing collection of the remaining particulates in said baghouse filter at said high filtration velocity.

4. In a conventional electrostatic precipitator having a housing enclosing electrostatic discharge and collecting electrodes for electrostatically filtering particulates from a flue gas, an inlet to said housing, and an outlet from said housing, a retrofit improvement comprising:

a tubesheet installed within a space vacated by removing at least one discharge electrode and collecting electrode from within said housing of said electrostatic precipitator; said tubesheet subdividing said vacated space into a separate filter section and an outlet section;

an electrostatic section comprising a plurality of remaining discharge electrodes and corresponding collecting electrodes for electrostatically removing a substantial portion of said particulates from said flue gas and for imparting a residual electrostatic charge on remaining particulates in said flue gas; and a compact baghouse filter installed in said separate filter section downstream of said electrostatic section for supplemental mechanical filtering of said remaining particulates from said flue gas before said residual charge substantially dissipates, said compact baghouse filter being supported on said tubesheet and having a high filtration velocity in the range of from 4.06–20.32 centimeters per second (8–40 feet per minute);

whereby a combination of removing said substantial portion of particulates from said flue gas in said electrostatic section and imparting a residual charge on the remaining particulates discharged to said separate filter section increases an efficiency of said baghouse filter to allow effective filtering of said remaining particulates from said flue gas at said high filtration velocity.

* * * * *